US011149663B2

(12) United States Patent
Kilfoyle et al.

(10) Patent No.: US 11,149,663 B2
(45) **Date of Patent: *Oct. 19, 2021**

(54) SYSTEMS AND METHODS FOR CONTROLLING TORQUE IN A VEHICLE

(71) Applicant: PACCAR Inc, Bellevue, WA (US)

(72) Inventors: Riley Sparman Kilfoyle, Carnation, WA (US); Christopher Balton, Bellingham, WA (US); Charles Wayne Reinhardt Swart, Bellingham, WA (US)

(73) Assignee: PACCAR Inc., Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/777,254

(22) Filed: Jan. 30, 2020

(65) Prior Publication Data

US 2020/0165988 A1 May 28, 2020

Related U.S. Application Data

(63) Continuation of application No. 15/678,865, filed on Aug. 16, 2017, now Pat. No. 10,570,832.

(51) Int. Cl.

| | |
|---|---|
| ***F02D 31/00*** | (2006.01) |
| ***F02D 41/14*** | (2006.01) |
| ***F02D 29/02*** | (2006.01) |

(52) U.S. Cl.

CPC ..... *F02D 31/001* (2013.01); *F02D 29/02* (2013.01); *F02D 41/1477* (2013.01); (Continued)

(58) Field of Classification Search

CPC ..... F02D 31/001; F02D 41/1477; F02D 2250/18; F02D 2200/1002; F02D 2200/101

See application file for complete search history.

(56) References Cited

U.S. PATENT DOCUMENTS

| | | | |
|---|---|---|---|
| 8,406,971 B2 | 3/2013 | Balton et al. | |
| 9,708,985 B1 * | 7/2017 | Van ryzin | F02D 29/02 |

(Continued)

FOREIGN PATENT DOCUMENTS

| | | |
|---|---|---|
| EP | 1124049 | 8/2001 |
| WO | 2005/051713 | 6/2005 |

OTHER PUBLICATIONS

PCT International Search Report and Written Opinion dated Dec. 6, 2018, issued in corresponding International Application No. PCT/US2018/000301, filed Aug. 16, 2017, 8 pages.

(Continued)

*Primary Examiner* — Carl C Staubach

(74) *Attorney, Agent, or Firm* — Merchant & Gould P.C.

(57) ABSTRACT

Techniques are disclosed herein that provide for controlling torque in a vehicle. In some embodiments, desired torque values are generated and are compared to an amount of torque currently being generated by an engine. If a different amount of torque is desired, an engine speed target is altered in a linear fashion, and then converted back to a torque request to be provided to an engine ECU for implementation. Techniques disclosed herein may cause changes in torque demand to be limited in such a way to cause predictable and smooth changes in engine speed, even when engine speed and torque do not have a linear relationship to each other.

18 Claims, 3 Drawing Sheets

(52) U.S. Cl.
CPC ..... *F02D 2041/1409* (2013.01); *F02D 2200/101* (2013.01); *F02D 2200/1002* (2013.01); *F02D 2250/18* (2013.01)

(56) References Cited

U.S. PATENT DOCUMENTS

| | | | | |
|---|---|---|---|---|
| 10,570,832 | B2 * | 2/2020 | Kilfoyle | F02D 29/02 |
| 2002/0148438 | A1 | 10/2002 | Ellims | |
| 2007/0246273 | A1 | 10/2007 | Tenbrock | |
| 2009/0058100 | A1 | 3/2009 | Aitchison | |
| 2010/0258368 | A1 | 10/2010 | Martin et al. | |
| 2010/0268435 | A1 * | 10/2010 | Bolander | F02D 41/0087 701/102 |
| 2012/0145123 | A1 * | 6/2012 | Ono | F02P 5/1508 123/339.11 |
| 2012/0271494 | A1 | 10/2012 | Kim et al. | |
| 2012/0304635 | A1 * | 12/2012 | Ooi | F02D 31/007 60/431 |
| 2013/0092127 | A1 | 4/2013 | Pirjaberi | |
| 2013/0325237 | A1 | 12/2013 | Ikegami et al. | |
| 2013/0325292 | A1 | 12/2013 | Park | |
| 2014/0052359 | A1 * | 2/2014 | Zhang | F02D 25/00 701/99 |
| 2017/0030274 | A1 * | 2/2017 | Nakanishi | F01P 11/16 |
| 2018/0305900 | A1 * | 10/2018 | Letscher | E02F 3/431 |

OTHER PUBLICATIONS

PCT International Preliminart Report on Patentability in Application PCT/US2018/000301, dated Feb. 27, 2020, 6 pages.

U.S. Appl. No. 15/678,865, Office Action dated Jan. 22, 2019, 10 pages.

U.S. Appl. No. 15/678,865, Office Action dated Jul. 3, 2019, 12 pages.

U.S. Appl. No. 15/678,865, Notice of Allowance dated Oct. 17, 2019, 7 pages.

European Supplementary Search Report in Application 18846841, dated Apr. 12, 2021, 10 pages.

* cited by examiner

SYSTEMS AND METHODS FOR CONTROLLING TORQUE IN A VEHICLE

This application is a Continuation of U.S. application Ser. No. 15/678,865, filed Aug. 16, 2017, and which application is incorporated herein by reference. To the extent appropriate, a claim of priority is made to the above disclosed application.

BACKGROUND

In existing vehicles, various components generate torque requests, and these torque requests are passed along to an engine ECU to cause an engine of the vehicle to produce the requested amount of torque. One problem with existing systems is that by using torque as the control input, the speed at which the engine operates may vary erratically. Even if torque requests are controlled such that the rate of change of the torque demand is limited, the engine speed may nevertheless change rapidly and unexpectedly due to the non-linear relationship between torque and engine speed. For example, changing loads on the engine may cause the engine speed to change, even without changing the amount of torque being produced or requested. These erratic changes in engine speed can cause rough operation for an operator of the vehicle, and can cause unwanted wear on the engine and other components. What is needed are devices and techniques that allow for changing torque requests to be processed without causing rapid and unexpected changes in engine speed.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In some embodiments, a vehicle is provided. The vehicle comprises an engine, an engine electronic control unit (ECU), and at least one electronic control unit (ECU). The engine ECU is configured to control torque output by the engine in response to received torque request values. The at least one ECU is configured to determine a desired torque value, use the desired torque value, a current engine speed target value, and a current torque value to determine a subsequent engine speed target value, wherein the current torque value represents an amount of torque being generated by the engine; convert the subsequent engine speed target value to a torque request value; and provide the torque request value to the engine ECU.

In some embodiments, a method of processing torque requests in a vehicle is provided. A desired torque value is determined. The desired torque value, a current engine speed target value, and a current torque value are used to determine a subsequent engine speed target value. The current torque value represents an amount of torque being generated by an engine of the vehicle. The subsequent engine speed target value is converted to a torque request value. The torque request value is provided to an engine electronic control unit (ECU) to control the amount of torque being generated by the engine.

In some embodiments, a non-transitory computer-readable medium is provided. The computer-readable medium has computer-executable instructions stored thereon that, in response to execution by at least one electronic control unit of a vehicle, cause the at least one electronic control unit to perform actions comprising determining a desired torque value; using the desired torque value, a current engine speed target value, and a current torque value to determine a subsequent engine speed target value, wherein the current torque value represents an amount of torque being generated by an engine of the vehicle; converting the subsequent engine speed target value to a torque request value; and providing the torque request value to an engine electronic control unit (ECU) to control the amount of torque being generated by the engine.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

As stated above, controlling the rate of change of torque demand alone is not effective in controlling a rate of change of engine speed, at least because the relationship between torque and engine speed is non-linear. Accordingly, in some embodiments of the present disclosure, a change in a desired amount of torque is converted into a change in an engine speed target value. For example, if the desired amount of torque is greater than a current amount of torque being generated, then the engine speed target value may be smoothly increased, and if the desired amount of torque is less than a current amount of torque being generated, then the engine speed target value may be smoothly decreased. The new engine speed target value may then be converted back into a torque request, and the new torque request is provided to the engine ECU to be implemented. In this way, the changes in the engine speed can be limited in a linear fashion, thus avoiding the rapid and unexpected changes in engine speed that are caused by limiting a rate of change of a torque demand without considering how the changing torque demand would affect engine speed.

Figure 1:
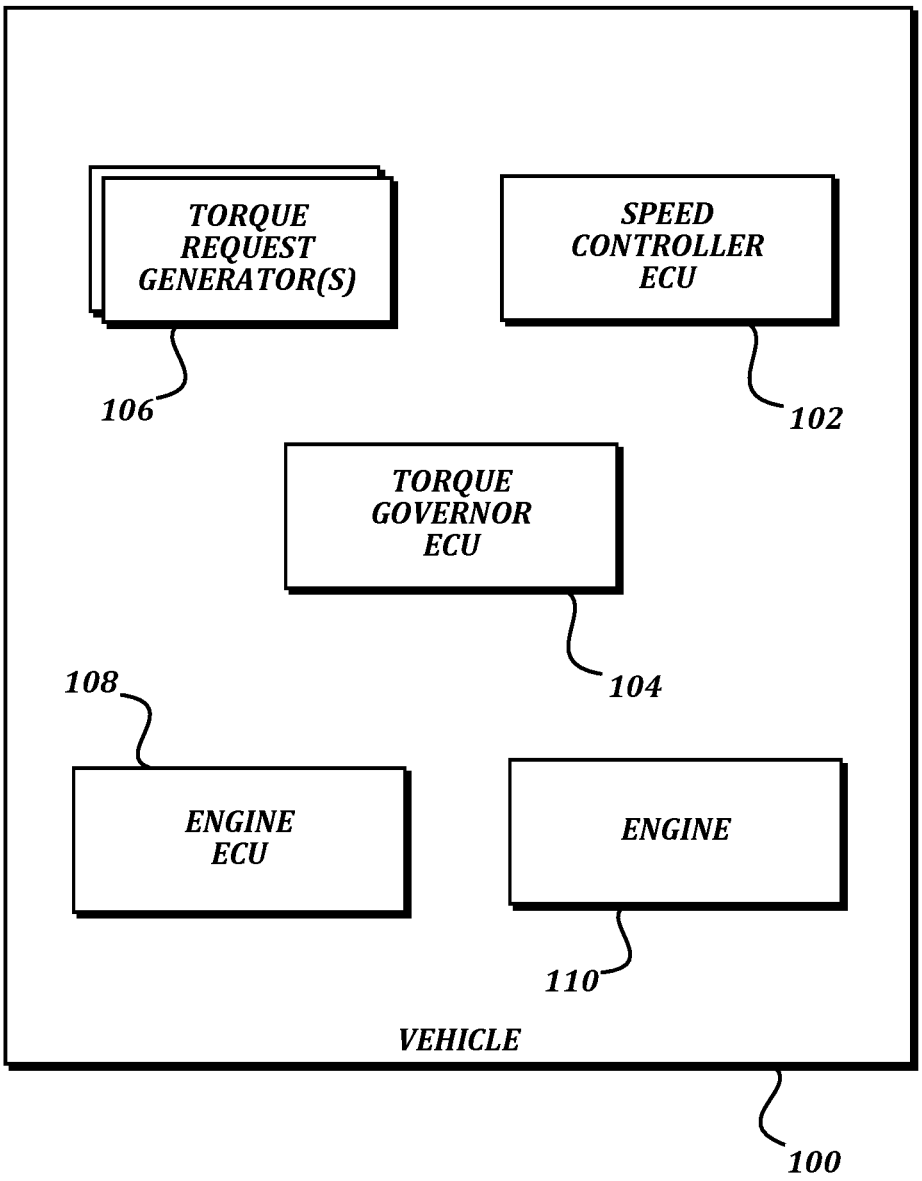
FIG. 1 is a block diagram that illustrates selected components of an example embodiment of a vehicle according to various aspects of the present disclosure.

FIG. 1 is a block diagram that illustrates selected components of an example embodiment of a vehicle according to various aspects of the present disclosure. In some embodiments, the vehicle 100 may be a Class 8 truck, though in other embodiments, any other type of vehicle may be used to include the illustrated components.

As illustrated, the vehicle 100 includes a speed controller electronic control unit (ECU) 102, a torque governor ECU 104, one or more torque request generators 106, an engine ECU 108, and an engine 110. As known to one of ordinary skill in the art, each of the ECUs 102, 104, 108 within the vehicle 100 is a computing device that includes a microcontroller, one or more types of memory, one or more inputs, and one or more outputs. Each of the ECUs may store instructions (or otherwise be operable to execute instructions provided to it) that cause the ECU to perform the actions described below. Though separate ECUs 102, 104, 108 are illustrated and described below, in some embodiments two or more of these ECUs 102, 104, 108 may be combined with each other into a single ECU. In some embodiments, the functionality described in one or more of the ECUs 102, 104, 108 may be split into multiple ECUs.

A torque request generator 106 is any component of a vehicle 100 that can generate a signal indicative of a desired amount of torque. One non-limiting example of a torque request generator 106 is a sensor that determines a position of an accelerator pedal and converts the position to an amount of torque desired. Another non-limiting example of a torque request generator 106 is a power-take-off (PTO) device controller that determines an amount of torque needed by the power-take-off system. Other examples of torque request generators 106 include, but are not limited to, an advanced braking system, an accident avoidance system, and a cruise control system.

In some embodiments, the speed controller ECU 102 receives torque requests from the one or more torque request generators 106. The speed controller ECU 102 determines an engine speed based on the torque requests, and provides the engine speed to the torque governor ECU 104. The torque governor ECU 104 then converts the engine speed to a torque request, and provides the torque request to the engine ECU 108. Further details of how the speed controller ECU 102 determines the engine speed and how the torque governor ECU 104 determines the torque request are provided below.

In some embodiments, the engine ECU 108 is an electronic component that functions to manage various aspects of the operation of the engine 110. For example, the engine's ignition timing, fuel consumption, and the like, may be monitored and controlled by the engine controller 108. The engine ECU 108 may modify these parameters in order to cause the engine 110 to produce a requested amount of torque. The engine ECU 108 may also communicate with one or more sensors of the engine 110 and may be configured to provide data from those sensors to other components. For example, the engine ECU 108 may be configured to determine a current engine speed, a current amount of torque being produced by the engine, and/or any other type of engine performance data known to one of ordinary skill in the art. In some embodiments, the engine 110 is an internal combustion engine, though this should not be seen as limiting. In some embodiments, the engine 110 may be another type of torque generating device capable of being controlled as described herein.

The various electronic components described above may communicate with each other through a vehicle-wide communications network (not illustrated). Those skilled in the art and others will recognize that the vehicle-wide communications network may be implemented using any number of different communication protocols such as, but not limited to, Society of Automotive Engineers' ("SAE") J1587, SAE J1922, SAE J1939, SAE J1708, and combinations thereof. Alternatively, the components described above may be provided by a single electronic component such as a general purpose controller or ECU residing on the vehicle 100, and so would not need to communicate via a network. It will be appreciated, however, that the present disclosure is not limited to any particular type or configuration of controller, or to any specific technique of communicating between components of the vehicle 100.

One of ordinary skill in the art will understand that embodiments of a vehicle 100 have more components than those illustrated, including but not limited to transmission components, wheels, fluid pumps, and so on. Such well-known components of a vehicle 100 have not been illustrated or described to improve the clarity of the description of the novel features presented herein.

Figure 2A:
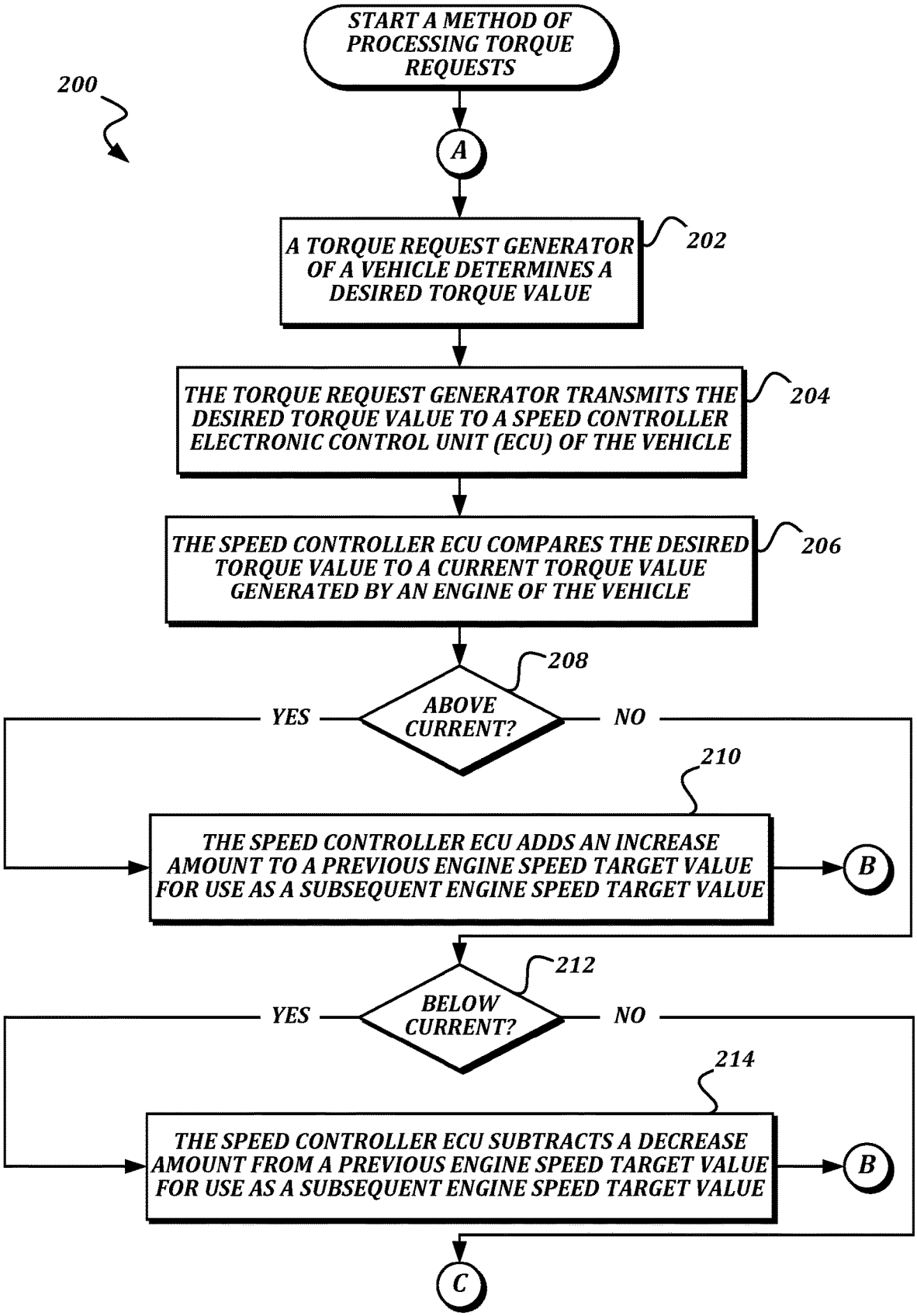
FIGS. 2A-2B are a flowchart that illustrates a method of processing torque requests according to various aspects of the present disclosure.
Figure 2B:
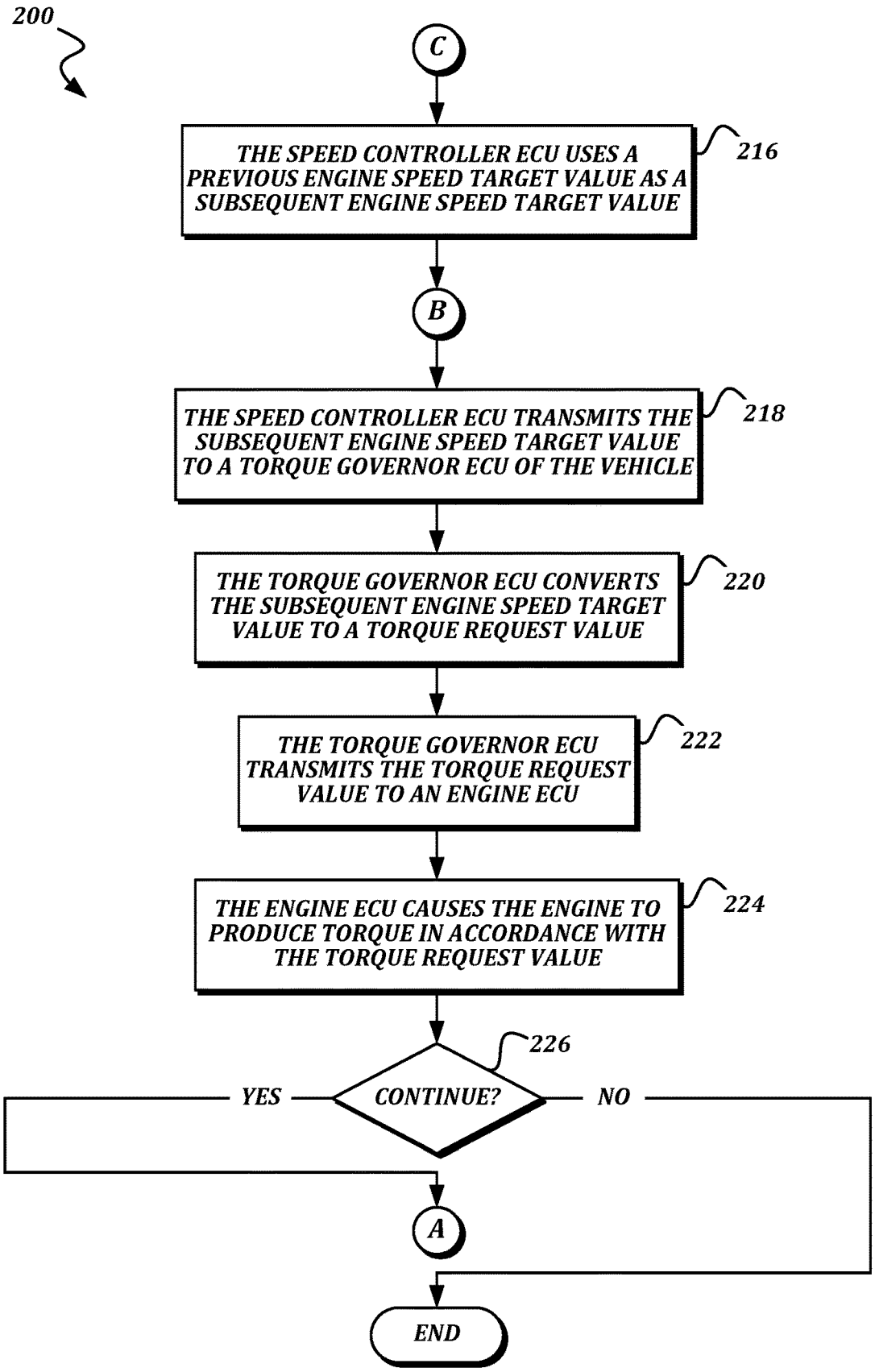

FIGS. 2A-2B are a flowchart that illustrates a method of processing torque requests according to various aspects of the present disclosure. From a start block, the method 200 proceeds through a continuation terminal ("terminal A") to block 202, where a torque request generator 106 of a vehicle 100 determines a desired torque value. This may occur in any manner appropriate to the particular torque request generator 106. For example, a power-take-off controller may determine, based on a control input to the power-take-off system, that a given torque amount is desired by the power-take-off system. As another example, an accelerator pedal sensor may detect that an accelerator pedal is depressed halfway, and may determine that half of the maximum torque (or some other suitable amount) is desired. As yet another example, a cruise control system may determine an optimal amount of torque to be used to maintain a given speed of travel.

Next, at block 204, the torque request generator 106 transmits the desired torque value to a speed controller electronic control unit (ECU) 102 of the vehicle 100. Though the below discussion assumes that a single desired torque value is transmitted to the speed controller ECU 102, in some embodiments, more than one torque request generator 106 may transmit desired torque values to the speed controller ECU 102. In such embodiments, the speed controller ECU 102 may use the highest desired torque value, may average the received desired torque values, may prioritize values from one torque request generator 106 over others, or may use any other suitable technique for determining a desired torque value to process based on the received desired torque values.

At block 206, the speed controller ECU 102 compares the desired torque value to a current torque value generated by an engine 110 of the vehicle 100. In some embodiments, the current torque value may be received from the engine ECU 108 by the speed controller ECU 102. In some embodiments, the speed controller ECU 102 may derive the current torque value based on values provided from other sensors. As one non-limiting example, the speed controller ECU 102 may use a current engine speed value to derive the current torque value using a torque map.

The method 200 then proceeds to a decision block 208, where a determination is made regarding whether the desired torque value is greater than the current torque value. In some embodiments, the determination may include a hysteresis value, such that the desired torque value is compared to the current torque value plus an increase hysteresis threshold amount instead of to the current torque value alone. This allows small increases in the desired torque value to be ignored, thereby improving the stability of the control method and avoiding unnecessary cycling of the functionality. In some embodiments, the increase hysteresis threshold amount may be configurable by the operator of the vehicle, with larger values providing increased stability but poorer responsiveness, and with smaller values providing greater responsiveness but decreased stability. In some embodiments, the increase hysteresis threshold amount may be determined while configuring the vehicle for delivery, and may not otherwise be configurable by the operator.

If the desired torque value is greater than the current torque value (and, optionally, is greater than the current torque value by at least the increase hysteresis threshold amount), then the result of decision block 208 is YES, and the method 200 advances to block 210. At block 210, the speed controller ECU 102 adds an increase amount to a previous engine speed target value for use as a subsequent engine speed target value. In some embodiments, the increase amount may be a fixed amount of engine speed (for example, 50 RPM) to be added to the previous engine speed target value. In some embodiments, the increase amount may be specified as an increase rate or slope (for example, 10 RPM per second), which is then converted to a fixed amount of engine speed by determining how much time has passed since a previous time the engine speed target value was updated. As with the increase hysteresis threshold amount, the increase amount may be configurable by the operator of the vehicle 100 in order to allow the engine speed to rise faster or slower, or may be determined while configuring the vehicle for delivery. The method 200 then proceeds to a continuation terminal ("terminal B").

Returning to decision block 208, if the desired torque value is not greater than the current torque value (or, optionally, is not greater than the current torque value by at least the increase hysteresis threshold amount), then the result of decision block 208 is NO, and the method 200 proceeds to another decision block 212. At decision block 212, a determination is made regarding whether the desired torque value is less than the current torque value. As with the determination in decision block 208, in some embodiments, the determination in decision block 212 may include a hysteresis value, such that the desired torque value is compared to the current torque value minus a decrease hysteresis threshold amount instead of to the current torque value alone. This again will allow small changes in the desired torque value to be ignored, to improve stability of the control method. As with the increase hysteresis threshold amount, in some embodiments the decrease hysteresis threshold amount may be configurable by the operator of the vehicle, and in some embodiments the decrease hysteresis threshold amount may be determined while configuring the vehicle for delivery.

If the desired torque value is less than the current torque value (and, optionally, is less than the current torque value by at least the decrease hysteresis threshold amount), then the result of decision block 212 is YES, and the method 200 advances to block 214. At block 214, the speed controller ECU 102 subtracts a decrease amount from a previous engine speed target value for use as a subsequent engine speed target value. As with the increase amount, the decrease amount may be configurable by an operator of the vehicle, may be determined while configuring the vehicle for delivery, may be a fixed amount of engine speed, and/or may be specified as a decrease rate or slope. In some embodiments, the increase amount and the decrease amount may be the same, while in some embodiments, two separate amounts may be provided for the increase amount and the decrease amount. The method 200 then proceeds to a continuation terminal ("terminal B").

Returning to decision block 212, if the desired torque value is not less than the current torque value (or, optionally, is not less than the current torque value by at least the decrease hysteresis threshold amount), then the result of decision block 212 is NO, and the method 200 proceeds to a continuation terminal ("terminal C"). From terminal C (FIG. 2B), the method 200 proceeds to block 216, where the speed controller ECU 102 uses a previous engine speed target value as a subsequent engine speed target value.

As will be understood by one of ordinary skill in the art and as described further below, the method 200 may be performed as a loop. In each of blocks 210, 214, 216, for the first time through the loop, the "previous engine speed target value" may be a default value, may be a current engine speed detected by an engine speed sensor, or may use any other appropriate initialization value. For subsequent executions of the loop, the determined subsequent engine speed target value may be stored for use as the previous engine speed target value in any computer-readable medium, such as a memory accessible by the speed controller ECU 102.

The method 200 then proceeds through terminal B to block 218, where the speed controller ECU 102 transmits the subsequent engine speed target value to a torque governor ECU 104 of the vehicle 100. At block 220, the torque governor ECU 104 converts the subsequent engine speed target value to a torque request value. The torque governor ECU 104 may use any suitable technique to convert the subsequent engine speed target value to a torque request value. In some embodiments, the torque governor ECU 104 may use a torque map to convert the subsequent engine speed target value to a torque request value. In some embodiments, the torque governor ECU 104 may implement a proportional-integral-derivative (PID) controller, wherein the PID controller uses the subsequent engine speed target value as the setpoint, uses the current engine speed as the process variable, and outputs the torque request as a control variable.

The method 200 then proceeds to block 222, where the torque governor ECU 104 transmits the torque request value to an engine ECU 108. Then, at block 224, the engine ECU 108 causes the engine 110 to produce torque in accordance with the torque request value. The engine ECU 108 may cause the engine to produce the requested amount of torque using any suitable technique known to one of ordinary skill in the art. For example, the engine ECU 108 may alter the fuel/air mixture, may alter variable valve timing, may alter ignition timing, or use other techniques to change the amount of torque generated by the engine 110. Causing the engine 110 to produce torque in accordance with the torque request value will cause the engine speed to approach the subsequent engine speed target value.

The method 200 then proceeds to a decision block 226, where a determination is made regarding whether the method 200 should loop and continue. Typically, the method 200 will continue as long as the vehicle 100 is operating and the speed controller functionality described herein is enabled. If the method 200 should continue, then the result of decision block 226 is YES, and the method 200 returns to terminal A. Otherwise, if the method 200 should stop, then the result of decision block 226 is NO, and the method 200 proceeds to an end block to terminate. In some embodiments, the loop within method 200 may execute rapidly in order to provide real-time control of the engine speed. For example, in some embodiments desired torque values may be received by the speed controller ECU 102 or generated by at least one torque request generator 106 each clock cycle, or once every 10 ms. In some embodiments, the remainder of the processing may then take two clock cycles, after which time the method 200 may loop back to receive the next desired torque value. The particular techniques used in the method 200 allow the torque requests to be generated so quickly, and thereby allow very fine-grained control. In some embodiments, the method 200 may implement a delay in order to wait longer before looping back to terminal A.

In the discussion above, the method 200 is described as determining whether the desired torque value is "greater than" or "less than" other values. One of ordinary skill in the art will recognize that, in some embodiments, these comparisons could be "greater than or equal to" and/or "less than or equal to" instead of strictly "greater than" and/or "less than."

One of ordinary skill in the art will also recognize that though the discussion above is provided in the context of an engine of a vehicle, in some embodiments, the techniques described herein may be used to control an engine that is not mounted in a vehicle. As some non-limiting examples, an auxiliary power unit, a stationary mounted pump unit, or any other type of device that includes an engine may use techniques such as those described herein to control torque generated by its engine.

While illustrative embodiments have been illustrated and described, it will be appreciated that various changes can be made therein without departing from the spirit and scope of the invention.

The invention claimed is:

1. A vehicle, comprising:

an engine;

an engine electronic control unit (ECU) configured to control torque output by the engine in response to received torque request values; and at least one additional ECU configured to:

determine a desired torque value;

use the desired torque value, a current engine speed target value, and a current torque value to determine a subsequent engine speed target value, wherein the current torque value represents an amount of torque being generated by the engine;

convert the subsequent engine speed target value to a torque request value; and provide the torque request value to the engine ECU;

wherein determining the subsequent engine speed target value comprises:

determining whether the desired torque value is greater than the current torque value by at least an increase threshold amount, wherein the increase threshold amount is greater than zero;

determining whether the desired torque value is less than the current torque value by at least a decrease threshold amount, wherein the decrease threshold amount is greater than zero;

generating the subsequent engine speed target value by adding an increase amount to the current engine speed target value in response to determining that the desired torque value is greater than the current torque value by at least the increase threshold amount;

generating the subsequent engine speed target value by subtracting a decrease amount from the current engine speed target value in response to determining that the desired torque value is less than the current torque value by at least the decrease threshold amount; and using the current engine speed target value as the subsequent engine speed value in response to determining that the desired torque value is not greater than the current torque value by at least the increase threshold amount and is not less than the current torque value by at least the decrease threshold amount.

2. The vehicle of claim 1, wherein the increase threshold amount is an increase hysteresis threshold amount, and wherein the decrease threshold amount is a decrease hysteresis threshold amount.

3. The vehicle of claim 1, wherein converting the subsequent engine speed target value to a torque request value includes determining the torque request value using a torque map.

4. The vehicle of claim 1, converting the subsequent engine speed target value to a torque request value includes providing the subsequent engine speed target value and the current engine speed target value as inputs to a PID controller that outputs the torque request value.

5. The vehicle of claim 1, further comprising at least one torque request generator and a CAN bus that communicatively couples the at least one torque request generator to the at least one additional ECU, wherein receiving the desired torque value includes receiving at least one signal via the CAN bus from the at least one torque request generator.

6. The vehicle of claim 5, wherein the at least one torque request generator includes at least one of an advanced braking system, an accident avoidance system, a cruise control system, an accelerator pedal sensor, and a power-take-off (PTO) device controller.

7. A method of processing torque requests in a vehicle, the method comprising:

determining a desired torque value;

using the desired torque value, a current engine speed target value, and a current torque value to determine a subsequent engine speed target value, wherein the current torque value represents an amount of torque being generated by an engine of the vehicle;

converting the subsequent engine speed target value to a torque request value; and providing the torque request value to an engine electronic control unit (ECU) to control the amount of torque being generated by the engine;

wherein determining the subsequent engine speed target value comprises:

determining whether the desired torque value is greater than the current torque value by at least an increase threshold amount, wherein the increase threshold amount is greater than zero;

determining whether the desired torque value is less than the current torque value by at least a decrease threshold amount, wherein the decrease threshold amount is greater than zero;

generating the subsequent engine speed target value by adding an increase amount to the current engine speed target value in response to determining that the desired torque value is greater than the current torque value by at least the increase threshold amount;

generating the subsequent engine speed target value by subtracting a decrease amount from the current engine speed target value in response to determining that the desired torque value is less than the current torque value by at least the decrease threshold amount; and using the current engine speed target value as the subsequent engine speed value in response to determining that the desired torque value is not greater than the current torque value by at least the increase threshold amount and is not less than the current torque value by at least the decrease threshold amount.

8. The method of claim 7, wherein at least one of the increase amount, the decrease amount, the increase threshold amount, and the decrease threshold amount is adjustable by an operator of the vehicle.

9. The method of claim 7, wherein converting the subsequent engine speed target value to a torque request value includes determining the torque request value using a torque map.

10. The method of claim 7, wherein converting the subsequent engine speed target value to a torque request value includes providing the subsequent engine speed target value and the current engine speed target value as inputs to a PID controller that outputs the torque request value.

11. The method of claim 7, wherein receiving the desired torque value includes receiving at least one signal via a CAN bus from a torque request generator.

12. The method of claim 11, wherein the torque request generator is an advanced braking system, an accident avoidance system, a cruise control system, an accelerator pedal sensor, or a power-take-off (PTO) device controller.

13. The method of claim 7, wherein the increase threshold amount is different from the decrease threshold amount.

14. A method of processing torque requests in a vehicle, the method comprising:

determining a desired torque value;

using the desired torque value, a current engine speed target value, and a current torque value to determine a subsequent engine speed target value, wherein the current torque value represents an amount of torque being generated by an engine of the vehicle;

converting the subsequent engine speed target value to a torque request value; and providing the torque request value to an engine electronic control unit (ECU) to control the amount of torque being generated by the engine;

wherein determining the subsequent engine speed target value comprises generating the subsequent engine speed target value by adding an increase amount to the current engine speed target value or by subtracting a decrease amount from the current engine speed target value;

wherein the increase amount is determined based on a specified increase rate that is converted to an increase speed based on an amount of time that has elapsed since a previous time when the engine speed target value was updated; and wherein the decrease amount is determined based on a specified decrease rate that is converted to a decrease speed based on the amount of time that has elapsed since a previous time when the engine speed target value was updated.

15. The method of claim 14, wherein converting the subsequent engine speed target value to a torque request value includes determining the torque request value using a torque map.

16. The method of claim 14, wherein converting the subsequent engine speed target value to a torque request value includes providing the subsequent engine speed target value and the current engine speed target value as inputs to a PID controller that outputs the torque request value.

17. The method of claim 14, wherein receiving the desired torque value includes receiving at least one signal via a CAN bus from a torque request generator.

18. The method of claim 17, wherein the torque request generator is an advanced braking system, an accident avoidance system, a cruise control system, an accelerator pedal sensor, or a power-take-off (PTO) device controller.

* * * * *